US009677146B2

(12) United States Patent
Schneider et al.

(10) Patent No.: US 9,677,146 B2
(45) Date of Patent: Jun. 13, 2017

(54) MANGANESE STEEL STRIP HAVING AN INCREASED PHOSPHOROUS CONTENT AND PROCESS FOR PRODUCING THE SAME

(75) Inventors: Reinhold Schneider, Wels (AT); Ludovic Samek, Linz (AT); Enno Arenholz, Plesching (AT); Klemens Mraczek, Leonding (AT); Mario Hartl, Eggendorf (AT)

(73) Assignee: VOESTALPINE STAHL GMBH, Linz (AT)

( * ) Notice: Subject to any disclaimer, the term of this patent is extended or adjusted under 35 U.S.C. 154(b) by 450 days.

(21) Appl. No.: 13/067,137

(22) Filed: May 11, 2011

(65) Prior Publication Data

US 2011/0308673 A1 Dec. 22, 2011

Related U.S. Application Data

(63) Continuation of application No. PCT/EP2009/008065, filed on Nov. 12, 2009.

(30) Foreign Application Priority Data

Nov. 12, 2008 (DE) ..... 10 2008 056 844

(51) Int. Cl.
*C21D 6/00* (2006.01)
*C21D 8/02* (2006.01)
*C22C 38/04* (2006.01)

(52) U.S. Cl.
CPC ..... *C21D 6/005* (2013.01); *C21D 8/0205* (2013.01); *C22C 38/04* (2013.01); *C21D 2211/001* (2013.01)

(58) Field of Classification Search
CPC ..... C21D 6/005; C21D 8/0205; C21D 2211/001; C22C 38/04
USPC ..... 148/329, 546; 420/72
See application file for complete search history.

(56) References Cited

U.S. PATENT DOCUMENTS 4,968,357 A 11/1990 Liu
5,431,753 A 7/1995 Kim et al.
5,647,922 A * 7/1997 Kim et al. ..... 148/620
6,358,338 B1 3/2002 Guelton et al.
6,387,192 B1 5/2002 Frommeyer et al.
(Continued)

FOREIGN PATENT DOCUMENTS

DE 39 03 774 C2 8/1990
DE 102 59 230 B4 4/2005
(Continued)

OTHER PUBLICATIONS

Machine translation of FR 2857980, 2005.*
International Search Report for PCT/EP2008/008065, Mailed Mar. 22, 2010.

*Primary Examiner* — Rebecca Lee

(57) ABSTRACT

A hot-rolled austenitic manganese steel strip having a chemical composition in percent by weight of 0.4%≤C≤1.2%, 12.0%≤Mn≤25.0%, P≥0.01% and Al≤0.05% has a product of elongation at break in % and tensile strength in MPa of above 65,000 MPa %, in particular above 70,000 MPa %. A cold-rolled austenitic manganese steel strip having the same chemical composition achieves a product of elongation at break in % and tensile strength in MPa of above 75,000 MPa %, in particular above 80,000 MPa %.

22 Claims, 5 Drawing Sheets

(56) References Cited

U.S. PATENT DOCUMENTS

| | | | | |
|---|---|---|---|---|
| 7,588,651 | B2 | 9/2009 | Engl et al. | |
| 7,799,148 | B2 | 9/2010 | Scott et al. | |
| 2006/0278309 | A1* | 12/2006 | Bouzekri et al. | 148/546 |
| 2008/0035248 | A1 | 2/2008 | Cugy et al. | |
| 2008/0035249 | A1 | 2/2008 | Scott et al. | |
| 2008/0053580 | A1* | 3/2008 | Drillet et al. | 148/620 |
| 2008/0240969 | A1 | 10/2008 | Kim et al. | |
| 2009/0010793 | A1* | 1/2009 | Becker et al. | 420/38 |
| 2009/0053556 | A1 | 2/2009 | Sohn et al. | |
| 2009/0165897 | A1 | 7/2009 | McEwan | |
| 2009/0196785 | A1 | 8/2009 | Spitzer et al. | |
| 2009/0202382 | A1 | 8/2009 | Kim et al. | |
| 2009/0308499 | A1 | 12/2009 | Scott et al. | |
| 2010/0065160 | A1 | 3/2010 | Meurer et al. | |

FOREIGN PATENT DOCUMENTS

| | | | | |
|---|---|---|---|---|
| DE | 10 2006 039 307 | B3 | 2/2008 | |
| EP | 0 573 641 | B1 | 9/1998 | |
| EP | 1 067 203 | B1 | 1/2001 | |
| EP | 0 889 144 | B1 | 7/2002 | |
| EP | 1 649 069 | A1 | 4/2006 | |
| EP | 1 573 075 | B1 | 11/2009 | |
| FR | 2 857 980 | A1 | 1/2005 | |
| FR | 2857980 | A1 * | 1/2005 | C21D 8/02 |
| FR | 2 881 144 | A1 | 7/2006 | |
| WO | 2005/019483 | A1 | 3/2005 | |
| WO | WO 2006048034 | A1 * | 5/2006 | C21D 8/02 |
| WO | 2006/077301 | A1 | 7/2006 | |
| WO | 2006/082104 | A1 | 8/2006 | |
| WO | 2007/024092 | A1 | 3/2007 | |
| WO | 2007/074994 | A1 | 7/2007 | |
| WO | 2007/075006 | A1 | 7/2007 | |
| WO | 2007/076748 | A1 | 7/2007 | |
| WO | 2008/007192 | A2 | 1/2008 | |

* cited by examiner

MANGANESE STEEL STRIP HAVING AN INCREASED PHOSPHOROUS CONTENT AND PROCESS FOR PRODUCING THE SAME

CROSS-REFERENCE TO RELATED APPLICATIONS

This application is a continuation application, under 35 U.S.C. Section 111(a), of PCT International Application No. PCT/EP2009/008065, filed Nov. 12, 2009, which claimed priority to German Application No. DE 10 2008 056 844.9, filed Nov. 12, 2008, the disclosures of which are incorporated herein in its entirety.

BACKGROUND

1. Field

The invention relates to an austenitic manganese steel strip and to a process for the production of austenitic manganese steel strips. The invention further relates to a manganese sheet steel comprising a reshaped sheet steel portion, in particular a stretch-formed or deep-drawn sheet steel portion.

2. Description of the Related Art

Manganese austenites are lightweight structural steels which are particularly tough and, at the same time, can stretch. The reduction in weight made possible by the greater strength makes manganese austenites a material which has high potential within the automotive industry. This is because the fuel consumption can be reduced as a result of lighter bodies, a high level of elongation capability and stability being important for the production of body parts and for their behaviour in crash conditions.

Transformation Induced Plasticity (TRIP) steels are already known and are increasingly used within the automotive industry. High-alloy TRIP steels achieve high tensile strengths up to more than 1000 MPa and may have stretching abilities up to approximately 30%. Owing to these high mechanical properties, thinner sheet metals and thus a reduction in body weight can be achieved in automotive construction. TRIP steel consists of a plurality of phases of iron-carbon alloys, substantially formed of ferrite, bainite and carbon-rich residual austenite. The TRIP effect is based on the deformation-induced conversion of the residual austenite into martensite. This remodelling of the crystal structure causes a simultaneous increase in strength and formability during product production or during product use in the event of a crash. The TRIP effect can be selectively influenced by adding the alloy elements of aluminium and silicon.

With TRIP steel a specific amount of the austenite has already been converted during the deep-drawing of the body part into the high-strength martensitic phase ($\alpha$-martensite), which can hardly be stretched. It is therefore possible that, in the case of TRIP steels, only a relatively low elongation reserve still remains for a crash situation.

The recently developed TWIP steels differ from TRIP steels in that they have a higher elongation at break (50% and above). The abbreviation TWIP stands for twinning induced plasticity, i.e. a plasticity which is induced by twinning. The specific stretching ability of TWIP steels can be produced by different mechanisms in the crystal structure. For example, the stretching ability may be promoted by lattice defects in the crystal structure, where the crystal structure may shear in a deformation-inducing manner, the shear mechanism taking place at a mirror plane and producing regularly mirrored crystal regions ('twins'). It is possible to distinguish between different twinning types. It is further known that other effects, such as the occurrence of slip bands, may influence the mechanical properties. Owing to the high stretching ability, TWIP steels are excellently adapted for the production of sheet metals within the automotive industry, in particular for regions of the body which are relevant in the event of a crash. TWIP steels have an austenitic structure and are characterised by a high manganese content (normally above 25%) and relatively high alloy additions of aluminium and silicon.

A problem addressed by the invention may lie in the provision of a steel having improved mechanical properties. In particular, a good level of weldability of the steel and/or a good level of formability are to be obtainable. Furthermore, the invention aims to provide a process for producing a steel having improved mechanical properties, in particular high ductility in combination with high tensile strength, and in particular good weldability and good formability.

SUMMARY

The problem addressed by the invention is achieved by the features of the independent claims. Advantageous configurations and developments are disclosed in the dependent claims.

It has been found that high mechanical properties and good weldability as well as good formability can be achieved with an austenitic manganese steel strip according to the invention. The steel according to the invention is characterised, inter alia, in that a manganese content of approximately $12.0\% \leq Mn \leq 25.0\%$ is present with a carbon content in percent by weight of approximately $0.4\% \leq C \leq 1.2\%$. In this specification the specified percentages of chemical constituents are always based on percent by weight. In accordance with the invention phosphorous, which increases the yield strength and tensile strength, reduces the elongation at break, promotes brittleness, reduces austenitic stability, impedes cementite precipitation and normally reduces weldability is alloyed in a relatively high amount of at least 0.01%. In this regard it has been noted that, with this alloy concept, high mechanical properties and a surprisingly good level of weldability with very good formability of the manganese steel strip produced can be obtained if the alloy element of aluminium is largely omitted ($Al \leq 0.05\%$).

In the case of a hot-rolled austenitic manganese steel strip having the chemical composition according to the invention a product with an elongation at break in MPa and tensile strength in percent of more than 60,000 MPa %, in particular more than 70,000 MPa % can be obtained. In the case of a cold-rolled austenitic manganese steel strip having the chemical composition according to the invention this product may lie above 75,000 MPa % and may lie above 80,000 MPa %, in particular even above 85,000 MPa %, preferably above 100,000 MPa %.

It is assumed that the good mechanical properties of the manganese steel according to the invention are based on a combination of at least the following three mechanisms:

(1) High-Density Microtwinning and Nanotwinning:

A preference for microtwinning (i.e. the formation of small, thin twins) was observed in the crystal structure during the reshaping process. The high density and the thinness of the microtwins observed after the reshaping strain (for example deep-drawing) compared to the density and thickness of the microtwins in conventional high manganese alloyed steels cause an increase in the elongation at break. This can be attributed, at least in part, to the fact that the number of dislocation obstacles increases considerably with the density of the twins. In samples of the manganese steel strip according to the invention which were subjected to a reshaping process, the mean thickness of the microtwins was preferably below 30 nm, in particular below 20 nm and in particular below 10 nm. Twins with a thickness of less than 10 nm are also known as nanotwins. Compared to conventional densities of twins, a significantly increased density of nanotwins was present in particular after the reshaping strain. It is assumed that as the phosphorous content increases and the stacking fault energy decreases, the density of the microtwins and, in particular, of the nanotwins increases. These have a direct effect on the ductility of the material and provide an unusually very high level of elongation in combination with high tensile strength.

(2) Solid Solution Hardening:

Solid solution hardening is caused by high amounts of interstitially dissolved alloy elements, such as P and C. High strengths (in particular greater than 1100 MPa) with simultaneously high strain hardening values and elongations at break (possibly greater than 90%) can thus be set.

(3) Dynamic Strain Ageing:

The occurrence of dynamic strain ageing is to be attributed to the high contents of interstitially dissolved alloy elements in the steel and is to be recognised on the basis of the stress-strain curve. This effect can result in an additional contribution to improvement of the strength and elongation at break of the material.

In addition, with a corresponding heat treatment the bake-hardening effect can also still be used to increase the yield strength.

For the steels produced the bake-hardening values (BH values) were ascertained in accordance with European standard EN 10325. The high amounts of interstitially dissolved alloy elements ensure an increased bake-hardening potential and can further improve the mechanical properties of the end product. An increase in strength after the heat treatment by approximately 30 to 80 MPa was observed depending on the level of strain.

It has been found that a low manganese content has a positive effect on the phase transitions and the reshaping mechanisms (in particular the formation of nanotwins and microtwins and greater solid solution hardening) in the end component. In this respect the manganese content of an austenitic manganese steel strip according to the invention can preferably lie in the range of 14%≤Mn≤18.0%, in particular 14%≤Mn 16.5%.

It was further found that a very uniform and high solid solubility of the elements C and/or P and/or N in the large grains can be achieved by a large grain size. The good solubility of these elements may also be a reason for the preference towards the small-size microtwinning and the nanotwinning and their high density in the crystal structure. It is further assumed that the normally negative effects of these elements (worsening of weldability, embrittlement of the steel) was surprisingly absent from the steel according to the invention as a result of the high solid solubility of P and C which is preferably obtained. In particular, high concentrations of C and P could be achieved without significantly worsening the weldability of the steel.

Since aluminium nitride (AlN) impairs the (austenitic) grain growth, the ratio of N to Al can selectively influence the grain size. As a result of the intentionally small addition of Al (for example Al≤0.05%, in particular Al≤0.02%) it is possible to achieve a large grain size in an austenitic manganese steel strip. In the alloy concept followed here, the Al content can be kept very low since lots of carbon is available for the deoxidation of the liquid steel. In particular, the manganese steel according to the invention can comprise a minimal aluminium content which is defined merely by unavoidable impurities in the production process (i.e. no aluminium addition). A maximum grain size growth during recrystallization (i.e. during hot-rolling or during annealing) is thus made possible in the steel strip according to the invention.

Furthermore, high phosphorous contents of 0.03%≤P, in particular 0.05%≤P, 0.06%≤P, 0.07%≤P, 0.08%≤P and also 0.10%≤P can be used expediently. A phosphorous content of 0.20%≤P may even be used. The tensile strength and, above all, the yield strength may increase with larger grain sizes owing to a high phosphorous content. Surprisingly, no substantial reduction in the elongation at break and no significant worsening of the weldability were observed with an increase in the phosphorous content. The tensile strength and the yield strength as well as the elongation at break of the steel strip produced can be altered selectively by an adjustment of the mean grain size in the metal structure. The larger the grain, the lower the tensile strength and also the yield strength, and the higher the elongation at break. Mean grain sizes of more than 5 μm or of more than 10 μm can be set. In particular it may be provided for a large mean grain size of more than 13 μm, in particular more than 18 μm to be set in the hot-rolled austenitic manganese steel strip, and for a large mean grain size of more than 15 μm, in particular more than 20 μm to be set in the cold-rolled austenitic manganese steel strip.

Similarly to aluminium, silicon also impairs the precipitation of carbides such as cementite ($(Fe, Mn)_3C$), which occurs during hot-rolling and during annealing. Since the precipitation of cementite reduces the elongation at break, it can be expected that the elongation of break can be increased by the addition of silicon.

However, the manganese steel according to the invention preferably comprises a very low silicon content (Si≤1.0%, in particular Si≤0.2%, particularly preferably Si≤0.05%), which is possibly defined merely by unavoidable impurities in the production process (i.e. in this instance no silicon addition; the Si content may thus lie below Si≤0.03%). The reason for this is that the silicon affects deformation mechanisms. Silicon impairs twinning, i.e. a low silicon concentration facilitates twinning and possibly particularly the formation of small microtwins and nanotwins. Since the deformation mechanism of the microtwinning and in particular of the nanotwinning highly favours a high elongation at break, this effect causes an increase in the elongation at break with a reduction in the silicon content. In this instance other deformation mechanisms can also be favoured as a result of a low silicon content. The silicon content of the manganese steel according to the invention can therefore be set to be low, preferably as low as possible. The silicon content can be kept very low since lots of carbon is available for the deoxidation of the liquid steel, and since the strength of the steel (silicon causes an increase in strength) is ensured by further measures, such as high concentrations of C and/or P.

Niobium (Nb), vanadium (V) and titanium (Ti) are elements which form precipitations (carbides, nitrides, carbonitrides) and can optionally be added in order to improve the strength by precipitation hardening. However, these elements have a grain-refining effect, which is why their concentration should be kept low if a large grain size is to still be ensured.

It is known that nickel (Ni) can stabilise the austenitic phase (what is known as a γ-stabiliser). Nickel can optionally be added in greater amounts (for example more than 1% to 5% or else 10%).

Apart from nickel the solid solution strengthener of chromium (Cr) also stabilises the α-ferrites. Additions of chromium up to 10 wt. % favour the formation of ϵ-martensite and/or α'-martensite, which results in a greater tensile hardening and a lower ductility. The amount of chromium should therefore be limited. For example Cr≤5%, in particular Cr≤0.2% can preferably be set.

Molybdenum (Mo) and tungsten (W) also exhibit a grain-refining effect. Tungsten has a high affinity for carbon and forms the hard and very stable carbides $W_2C$ and WC steel. The amount of tungsten should be limited. W≤2%, in particular W≤0.02% can preferably be set. Tungsten is a better solid solution strengthener than chromium and also forms carbides (although to a lesser extent than chromium). Mo≤2%, in particular Mo≤0.02% can preferably be set.

The grain size of a hot-rolled steel strip is further heavily influenced by the final rolling temperature during hot-rolling. The steel strip according to the invention can be rolled with a final rolling temperature between 750° C. and 1050° C., preferably between 800° C. and 900° C. With the given chemical composition the mean grain size can be set by the selection of the final rolling temperature.

It could be shown that with the hot-rolled steel according to the invention a high elongation at break of 60% or 65% and more could be achieved. The tensile strength of the hot-rolled steel may preferably lie above 1050 MPa in this case.

The mechanical properties of the hot-rolled austenitic manganese steel strip can be increased by cold-rolling. The grain size of a cold-rolled steel strip is heavily influenced by the annealing temperature. The annealing process which takes place after the cold-rolling can be carried out, for example, at an annealing temperature between 750° C. and 1050° C., and in particular the annealing temperature may be greater than 900° C. Tensile strengths above 1100 MPa, in particular above 1200 MPa with an elongation at break above 75%, in particular above 80% can be achieved.

A manganese steel strip according to embodiments of the invention having the aforementioned chemical composition comprises a reshaped, in particular stretch-formed or deep-drawn steel sheet portion, of which the structure comprises microtwins with a mean thickness less than 30 nm, in particular less than 20 nm, and nanotwins with a mean thickness less than 10 nm. As mentioned, these microtwins and nanotwins remain during the reshaping process, wherein the high mechanical properties of the starting product are presumably to be attributed, at least in part, to this deformation mechanism.

In a process for producing a hot-rolled austenitic manganese steel strip the semi-finished product is heated to a temperature above 1100° C. once it has been cast from steel. The heated semi-finished product is rolled with a final rolling temperature between 750° C. and 1050° C., preferably between 800° C. and 900° C. The rolled steel strip is then cooled at a rate of 20° C./s or quicker. The hot-rolled steel strip is preferably cooled rapidly at a rate of 50° C./s or quicker, in particular 200° C./s or quicker. Rapid cooling contributes to a high solid solubility of the elements C, N and P in the grains. Visually speaking, the rapid cooling leads to a 'freezing' of the dissolved elements, either with no precipitation or else only slight precipitation. In other words, precipitation can be largely eliminated by rapid cooling. In particular both the occurrence of grain boundary carbides and embrittlement (grain boundary segregations) of the steel structure caused by high phosphorous contents can be prevented by rapid cooling. The quicker the cooling rate, the better and more uniform carbon and phosphorous can be kept in solution. Cooling rates quicker than 100° C./s to 400° C./s were used. Cooling rates quicker than 400° C./s and even up to quicker than 600° C./s are also possible. If necessary, an intermediate phase of several seconds, in particular 1 to 4 seconds, may elapse before the rapid cooling, during which phase the steel strip is slowly cooled by air in order to improve the recrystallization of the phosphorous-alloyed steel strip.

In order to produce a cold-rolled austenitic manganese steel strip the hot-rolled steel strip is cold-rolled and then annealed for recrystallization.

In cold-rolling a high reduction in thickness in the region of more than 45%, in particular more than 60%, particularly preferably more than 80% is obtained by the application of high rolling forces.

The annealing temperature may be between 750° C. and 1150° C., and in particular is greater than 900° C. By annealing, the grain size is changed again, wherein after the annealing process a grain size of more than 15 μm, in particular more than 20 μm can be provided in order to achieve a high elongation at break and possibly an improvement in the solid solubility of carbon, phosphorous and optionally nitrogen. A high tensile strength may be ensured, in particular by a relatively high content of phosphorous (and carbon).

After the annealing process the rolled steel strip is cooled at a rate of 20° C./s or quicker. Rapid cooling of the cold-rolled steel strip is preferably carried out at a rate of 50° C./s of quicker, in particular 200° C./s or quicker.

As already described in the hot-strip process, in this case too rapid cooling contributes to a high and uniform solid solubility of carbon, phosphorous and nitrogen in the grains, and therefore to a high tensile strength, even with large grains. Cooling rates of more than 100° C./s to 400° C./s were used. Cooling rates quicker than 400° C./s, and even up to quicker than 600° C./s are also possible. If necessary, an intermediate phase of several seconds, in particular 1 to 6 seconds, may elapse before the rapid cooling, during which phase the steel strip is slowly cooled by air in order to improve the recrystallization of the phosphorous-alloyed steel strip.

BRIEF DESCRIPTION OF THE DRAWINGS

The invention will be described hereinafter in greater detail on the basis of practical examples and, by way of example, with reference to the drawings, in which.

DESCRIPTION OF EMBODIMENTS

Figure 1:
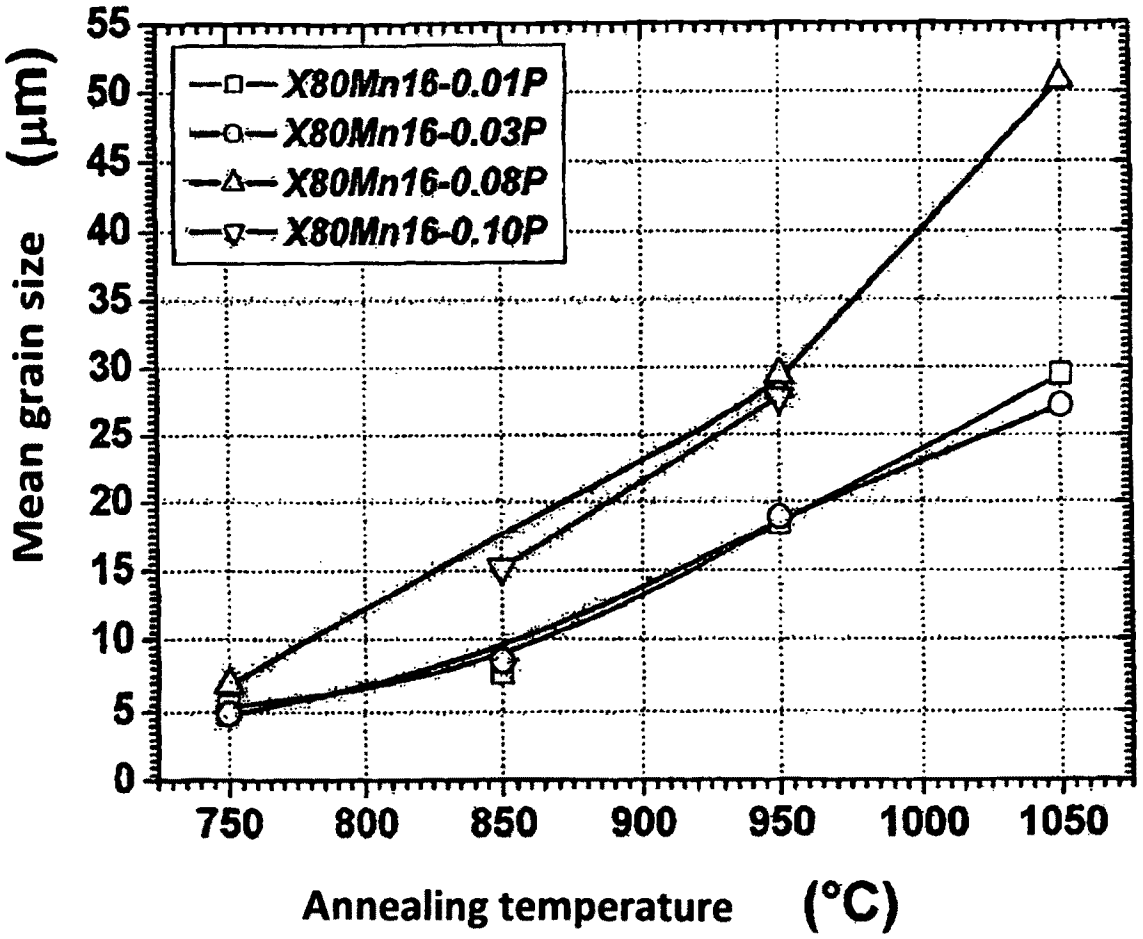
FIG. 1 is a graph showing the mean grain size for cold-rolled steels compared with the annealing temperature.

Different possibilities for producing manganese steels according embodiments of the invention will first be described by way of example.

In a first approach the pig iron is produced in a blast furnace or by a smelting-reduction process, such as Corex or Finex. The Tecnored process is also possible. For example, the pig iron is then converted into steel in a basic oxygen process (for example in a LD (Linz-Donawitz)/BOF (bottom oxygen furnace) process). Vacuum degassing (for example by the Ruhrstahl-Heraeus process (RH)) may be carried out before the steel is cast and a ladle furnace may be used to heat and alloy the molten metal. A second approach, which may be particularly suitable for manganese steels, uses an electric arc furnace (EAF) to produce steel and an AOD converter to decarbonise the liquid steel. A ladle furnace can again be used to heat and alloy the molten metal before the steel is cast.

The steel thus produced can be processed further by means of different casting methods, such as ingot casting, continuous casting, thin-strip casting or strand casting. The steel body produced during the casting process is called a semi-finished product and may be formed, for example, as slabs, billets or blocks.

The slab is processed further in hot strip mills to form a hot strip. Rolling stands for narrow strips (width less than 100 mm), medium strips (width between 100 mm and 600 mm) and wide strips (width greater than 600 mm) can be used for this purpose. The processing of blocks and billets to form profiled parts, pipes or wires is further possible.

A hot-strip process (WB) will be described hereinafter, in accordance with which steel strips according to the invention can be produced.

When producing steel strips according to the invention a rolling temperature of between approximately 1100° C. and 1300° C., optionally also higher, can be used. The final rolling temperature may lie, for example, between 750° C. and 1050° C., and in particular between 800° C. and 900° C. Different mean grain sizes of the hot-rolled steel strip are produced by different final rolling temperatures in accordance with the dynamic recrystallization at the prevailing temperature. The lower the final rolling temperature, the smaller the mean grain size obtained with the given chemical composition. With a reduction of the mean grain size the tensile strength and the breaking strength of the hot-rolled steel strip increase and the elongation at break decreases. However, with a final rolling temperature which is too low there is a risk that the high grain refining in manganese steels will lead to a loss in plastic deformability as a result of the increased strength. Furthermore, low final rolling temperatures lead increasingly to the formation of cementite ($(Fe, Mn)_3C$) owing to the phase stability, whereby the mechanical properties may be impaired. With final rolling temperatures below 740° C. the cementite precipitations achieved a particle size which led to considerable impairment of the mechanical properties.

The mean grain size of the hot-strip steel strip is further influenced by the content of aluminium and nitrogen. It is known that manganese increases the solubility of nitrogen in liquid iron. In liquid iron dissolved nitrogen, together with aluminium, forms aluminium-nitride precipitations which impair the migration of grain boundaries and thus impair grain growth. Aluminium nitride can further lead to cracking during hot-forming. It has been found that, as a result of selective control of the aluminium and nitrogen content in the steel, low final rolling temperatures considerably below 950° C. and in particular below 900° C., up to below 750° C. are possible without the occurrence of cracking. However, the formation of large cement particles, which are introduced with a reduction in the final rolling temperature below approximately 740° C. to 800° C., is to be avoided. Particularly preferred final rolling temperatures during the hot-rolling process may thus lie in the range of 800° C. to 900° C.

For example, the avoidance of cracking at the aforementioned final rolling temperatures in the range of 800° C. to 900° C. was achieved with chemical compositions in which an extremely low amount of aluminium up to a maximum of 0.008% or 0.010% was used in combination with a low content of nitrogen up to a maximum, for example, of 0.030% or 0.036%. The respective concentrations of the elements are mutually dependent. If less nitrogen is used, more aluminium is allowed and vice versa. In this respect higher nitrogen contents than those disclosed above are also possible with a low aluminium content.

After the hot-rolling the hot strip is cooled rapidly at the quickest possible cooling rates (for example quicker than 50° C./s or even higher). The cooling may be carried out by subjecting the hot strip to water.

The hot strip is then cleaned (de-scaled), for example with sulphuric acid, in a continuously operating pickling plant. For example the hot strip may have a thickness of 1.5 to 2.0 mm. However, hot-strip products may also be produced which have smaller or greater strip thickness than those disclosed above. An annealing step is not normally carried out with the hot-strip products produced in this instance. However, in a specific embodiment such an annealing strip is, in fact, carried out and causes a grain enlargement as well as an increase in the elongation at break.

The hot strip produced in the aforementioned manner can be processed further by cold-rolling and annealing to form a cold-strip product. The hot strip is further reduced in terms of thickness by cold-rolling and the mechanical properties of the strip are set. For example thin strip thicknesses in the range of approximately 0.7 mm to 1.75 mm of the cold strip may be produced. Cold-strip products with such thin thicknesses are of benefit, in particular, in the automotive field for crash-absorbing components. However, cold-strip products with lesser or greater strip thickness than those disclosed above can also be formed.

Cold-rolling is preferably carried out with the application of high rolling forces. Mill stands with 2 to 20 rollers can be used. For example, in order to apply the high cold-rolling forces, mill stands which are designed for high rolling pressures and which comprise 12 or 20 rollers can be used, in particular those of the Sendzimir type (cluster mills). A Sendzimir mill system comprising 12 rollers consists, for example, of a symmetrical arrangement in each case formed of 3 rear rollers, 2 intermediate rollers and 1 press roller which defines the roll gap. A Sendzimir mill system comprising 20 rollers consists, for example, of a symmetrical arrangement in each case formed of 4 rear rollers, 3 outer intermediate rollers, 2 inner intermediate and 1 press roller which defines the roll gap. A surprisingly good rollability and low cracking were demonstrated compared to other manganese steels.

The reduction in thickness in percent (cold-rolling degree) achieved with cold-rolling may be over 40% and, for example may be between 40% and 60%. The cold-rolling process was also carried out with cold-rolling degrees above 60%, in particular also above 80%. Cold-rolling was carried out with and without tension.

After the cold-rolling process or in an intermediate step during the cold-rolling, the steel strip is annealed for recrystallization. For example the annealing process may be carried out by the continuous annealing process or by the bell annealing process. The hardening of the structure which occurs during cold-rolling is reversed again by the annealing. In this instance the structure is reconstructed via nucleation and grain growth.

The annealing process may be carried out at temperatures between 750° C. and 1250° C., in particular 750° C. to 1150° C. and may last for approximately 5 seconds to 5 minutes, in particular 2 to 5 minutes at the annealing temperature. The annealing time is sufficient to heat substantially the entire volume of the strip to the respective annealing temperature. A plurality of rolling steps and intermediate annealing steps may also be carried out at a suitable temperature, for example approximately 950° C.

After the annealing process the hot steel strip is rapidly cooled, preferably by quenching it with water or in a gas flow (gas jet). It has been found that a particularly rapid cooling process is helpful in producing a high solid solubility of the elements C, N and P in the grains. In particular the embrittlement (grain boundary segregations), which is critical with a high phosphorous content, could be largely or completely prevented by increasing the cooling rate. Cooling rates quicker than approximately 50° C. or quicker than 100° C. per second are advantageous. Cooling rates quicker than 200° C., 300° C. or 400° C. per second can preferably further be provided, tests with cooling rates above 500° C. and above 600° C. per second also being carried out successfully.

After the cold-rolling, annealing and cooling processes a skin pass rolling (temper pass rolling) process can be carried out in order to set a suitable evenness of the cold strip. With skin pass rolling it is possible to achieve reductions in thickness of, for example, 0.5%, 1.5%, 5%, 25% and more than 40%, or suitable intermediate values.

Further process steps, such as galvanizing (for example hot-galvanizing or zinc-plating) can be added on depending on the field of application and customer requirements.

The chemical composition of the steel may vary over a wide range in further alloy elements. For example, the following may optionally be provided as an upper threshold value: 0.5%≥V, 0.5%≥Nb, 0.5%≥Ti, 10%≥Cr, 10%≥Ni, 1%≥W, 1%≥Mo, 3%≥Cu, 0.02%≥B, the rest, as mentioned, being iron and impurities caused by the production process. Specific practical examples of the invention utilise the following ranges: 0.85%≥C≥0.70%, 16.2%≥Mn≥15.5%, 0.015%≥Al≥0.0005%, 0.028%≥Si≥0.001%, 0.039%≥Cr≥0.020%, 0.08%≥Ni≥0.02%, 0.025%≥Nb≥0.020%, 0.002%≥Ti≥0.0015%, 0.0056%≥V≥0.002%, 0.04%≥N≥0.015%, 0.2%≥P≥0.01%. In particular, as the following examples show, extremely high phosphorous concentrations of, for example, more than 0.10%≤P or even 0.12%≤P may also be provided.

The invention will be described hereinafter in greater detail on the basis of practical examples.

Table 1 shows the chemical composition of four steel strips X80Mn16-0.01P, X80Mn16-0.03P, X80Mn16-0.08P and X80Mn16-0.10P with a phosphorous concentration between 0.011 and 0.102 wt. %.

TABLE 1

| Chemical Composition | | | | |
|---|---|---|---|---|
| Element | X80Mn16—0.01P | X80Mn16—0.03P | X80Mn16—0.08P | X80Mn16—0.010P |
| C | 0.79 | 0.79 | 0.75 | 0.81 |
| Mn | 16.0 | 15.8 | 16.0 | 16.1 |
| P | 0.011 | 0.032 | 0.083 | 0.102 |
| Si | 0.001 | 0.001 | 0.001 | 0.001 |
| Al | 0.009 | 0.010 | 0.005 | 0.005 |
| N | 0.033 | 0.036 | 0.034 | 0.035 |
| Cr | 0.031 | 0.027 | 0.026 | 0.032 |
| Ni | 0.029 | 0.025 | 0.024 | 0.031 |
| Nb | 0.022 | 0.022 | 0.022 | 0.025 |
| Ti | 0.002 | 0.002 | 0.002 | 0.002 |
| V | 0.006 | 0.003 | 0.004 | 0.005 |
| S | 0.0035 | 0.0025 | 0.001 | 0.001 |
| Cu | 0.017 | 0.016 | 0.016 | 0.018 |
| Mo | 0.017 | 0.017 | 0.015 | 0.017 |
| Sn | 0.005 | 0.005 | 0.004 | 0.006 |
| Zr | 0.001 | 0.001 | 0.001 | 0.001 |
| As | 0.005 | 0.005 | 0.005 | 0.005 |
| B | 0.0001 | 0.0001 | 0.0001 | 0.0001 |
| Co | 0.006 | 0.009 | 0.006 | 0.006 |
| Sb | 0.001 | 0.001 | 0.001 | 0.001 |
| Ca | 0.0001 | 0.0001 | 0.0001 | 0.0001 |

The hot-strip process (WB) was carried out in each case in accordance with the details stated above. The final rolling temperatures used (between 750° C. and 1030° C.) and the mechanical properties obtained of the produced hot strip products X80Mn16-0.01P, X80Mn16-0.03P, X80Mn16-0.08P and X80Mn16-0.10-P are given in Table 2. The mechanical values obtained in the tensile tests were determined in accordance with European standard "EUROPEAN STANDARD EN 10002-1, July 2001", which is hereby included in the disclosure of this specification by way of reference. All the values given in Table 2 are also disclosed as lower threshold values for the variable on which they are based.

TABLE 2

| Mechanical Properties (hot strip) | | | | | | |
|---|---|---|---|---|---|---|
| WB no. | Chemical composition | Final rolling temperature (° C.) | Rm (MPa) | Elongation at break (%) | Elong. at break × Rm (% MPa) | Mean grain size (μm) |
| 1 | X80Mn16-0.01P | 750 | 1081 | 60.9 | 65787 | 5 |
| 2 | X80Mn16-0.01P | 890 | 1103 | 67.5 | 74496 | 15.7 |
| 3 | X80Mn16-0.01P | 1030 | 1065 | 62.6 | 66701 | 18 |

TABLE 2-continued

| Mechanical Properties (hot strip) | | | | | | |
|---|---|---|---|---|---|---|
| WB no. | Chemical composition | Final rolling temperature (° C.) | Rm (MPa) | Elongation at break (%) | Elong. at break × Rm (% MPa) | Mean grain size (μm) |
| 4 | X80Mn16-0.01P | 1015 | 987 | 70.6 | 69676 | 26.3 |
| 5 | X80Mn16-0.03P | 870 | 1200 | 71.1 | 85320 | 13.9 |
| 6 | X80Mn16-0.08P | 920 | 1098 | 59.4 | 65221 | 17.6 |
| 7 | X80Mn16-0.08P | 950 | 928 | 81.9 | 70550 | 30.5 |
| 8 | X80Mn16-0.08P | 975 | 983 | 77.6 | 80614 | 31.6 |
| 9 | X80Mn16-0.10P | 950 | 946 | 85.9 | 76602 | 34.3 |
| 10 | X80Mn16-0.10P | 975 | 981 | 81.3 | 79783 | 30.1 |

As already mentioned, the hot strip (WB) can optionally be processed further to form a cold strip (KB). In the practical examples presented in this instance the cold-strip processing was carried out with the processing parameters given in Table 3. The mechanical properties of the cold-strip products produced in this manner of the chemical compositions X80Mn16-0.01P, X80Mn16-0.03P, X80Mn16-0.08P and X80Mn16-0.10P are given in Table 3. All the values given in Table 3 are also disclosed as lower threshold values for the variable on which they are based.

TABLE 3

| Mechanical Properties (cold strip) | | | | | | | | |
|---|---|---|---|---|---|---|---|---|
| KB no. | Composition | Final rolling temperature (° C.) in the hot-strip process | Annealing temperature (° C.) | Cold-rolling degree (%) | Tensile strength Rm (MPa) | Elongation at break $A_{50}$ (%) | Elong. at break × Rm (% MPa) | Mean grain size (μm) |
| 1 | X80Mn16-0.01P | 900 | 750 | 48.0 | 1240 | 62.0 | 76545 | 5.4 |
| 2 | X80Mn16-0.01P | 900 | 850 | 48.0 | 1162 | 88.5 | 102883 | 7.7 |
| 3 | X80Mn16-0.01P | 900 | 1050 | 48.0 | 1065 | 94.0 | 100238 | 29.4 |
| 4 | X80Mn16-0.03P | 900 | 750 | 53.8 | 1261 | 61.0 | 76530 | 5.0 |
| 5 | X80Mn16-0.03P | 900 | 750 | 47.5 | 1217 | 77.4 | 94256 | 4.9 |
| 6 | X80Mn16-0.03P | 900 | 950 | 47.5 | 1100 | 94.0 | 103147 | 18.9 |
| 7 | X80Mn16-0.08P | 900 | 950 | 65.4 | 1046 | 81.8 | 84527 | 28.3 |
| 8 | X80Mn16-0.08P | 950 | 950 | 65.4 | 1146 | 91.8 | 105203 | 29.4 |
| 9 | X80Mn16-0.10P | 900 | 950 | 65.4 | 1021 | 78.1 | 79781 | 27.8 |
| 10 | X80Mn16-0.10P | 850 | 950 | 65.4 | 1121 | 88.3 | 98984 | 15.2 |

As can be seen from Table 3, the cold-strip products with the KB numbers 1 to 7 and 9 were rolled in the hot-strip process with a final rolling temperature of 900° C. In the other cases the same hot-strip process was used as that forming the basis of the hot-strip products in Table 2.

The hot-strip product with the WB number 2 thus approximately forms the basis of the cold-strip products with the KB numbers 1 to 3 (the final rolling temperatures only differ by 10° C.) and the hot-strip product with the WB number 5 approximately forms the basis of the cold-strip products with the KB numbers 4 to 6 (the final rolling temperatures only differ by 30° C.).

Table 3 shows that tensile strengths Rm above 1100 MPa and even above 1200 MPa are achieved, and that tensile strengths Rm above 1000 MPa are still achieved even with large mean grain sizes (above 15 μm in the case of X80Mn16-0.03P (KB no. 6) and X80Mn16-0.10P (KB no. 10) and above 20 μm or optionally even 25 μm in the case of the other samples). The tensile strength Rm is defined as the stress occurring with maximum tensile force on the workpiece.

The elongation at break $A_{50}$ given in Table 3 is the remaining change in length, based on the initial length measurement and given in percent, once the tensile test results in a break (in accordance with the aforementioned standard EN 10002-1), an initial length measurement of 50 mm being taken as a basis. It was found for the steel strips that high elongation at break values over 75% and, in particular with large mean grain sizes, sometimes over 80% and even over 90% can be achieved.

A further important parameter for the mechanical properties of the steel strips is the product of tensile strength and elongation at break. High product values are achieved, particularly with large mean grain sizes. The reason for this is that large grain sizes lead to higher elongation at break values and the tensile strength, which normally decreases considerably with increasing grain size, is maintained to the greatest possible extent in accordance with the invention by the relatively high carbon and/or phosphorous content.

In the welding tests a very good level of weldability could be determined in the hot strip and cold strip, even with the higher P contents of 0.08% and 0.1% (X80MN16-0.08P and X80MN16-0.10P), i.e. in all samples unbuttonings were achieved as the type of break.

Table 4 shows the results of a test on weldability of the steels of the chemical compositions X80Mn16-0.01P, X80Mn16-0.03P, X80Mn16-0.08P and X80Mn16-0.10P:

TABLE 4

| Test on Weldability | | | |
|---|---|---|---|
| Composition | Imin (kA) | Imax (kA) | deltal (kA) |
| X80Mn16—0.01P | 5.2 | 6.3 | 1.1 |
| X80Mn16—0.03P | 4.7 | 5.8 | 1.1 |
| X80Mn16—0.08P | 5.2 | 6.4 | 1.2 |

TABLE 4-continued

| Test on Weldability | | | |
|---|---|---|---|
| Composition | Imin (kA) | Imax (kA) | deltal (kA) |
| X80Mn16—0.08P | 5.3 | 6.6 | 1.3 |
| X80Mn16—0.10P | 5.2 | 6.4 | 1.2 |
| X80Mn16—0.10P | 5.1 | 6.6 | 1.5 |

In accordance with Table 4 a welding range deltal of at least 1.1 kA is determined with all steel strips, which exceeds the 1.0 kA necessary for good weldability.

FIG. 1 shows the mean grain size of the cold-strip steel strips, which are low in aluminium nitride, given in Table 3 with the chemical compositions X80Mn16-0.01P, X80Mn16-0.03P, X80Mn16-0.08P and X80Mn16-0.10P as a function of the annealing temperature during the cold-strip process. A final rolling temperature of 900° C. in the hot-strip process formed the basis of the cold-strip products presented here. It can be seen from the graph that the steel strips X80Mn16-0.01P and X80Mn16-0.03P achieve mean grain sizes above 15 μm at annealing temperatures of approximately 920° C. The steel strips, which are rich in phosphorous, of the chemical compositions X80Mn16-0.08P and X80Mn16-0.10 achieved yet greater mean grain sizes at comparative annealing temperatures. The mean grain sizes were determined by light-microscopic examinations of micrographs.

Figure 2:
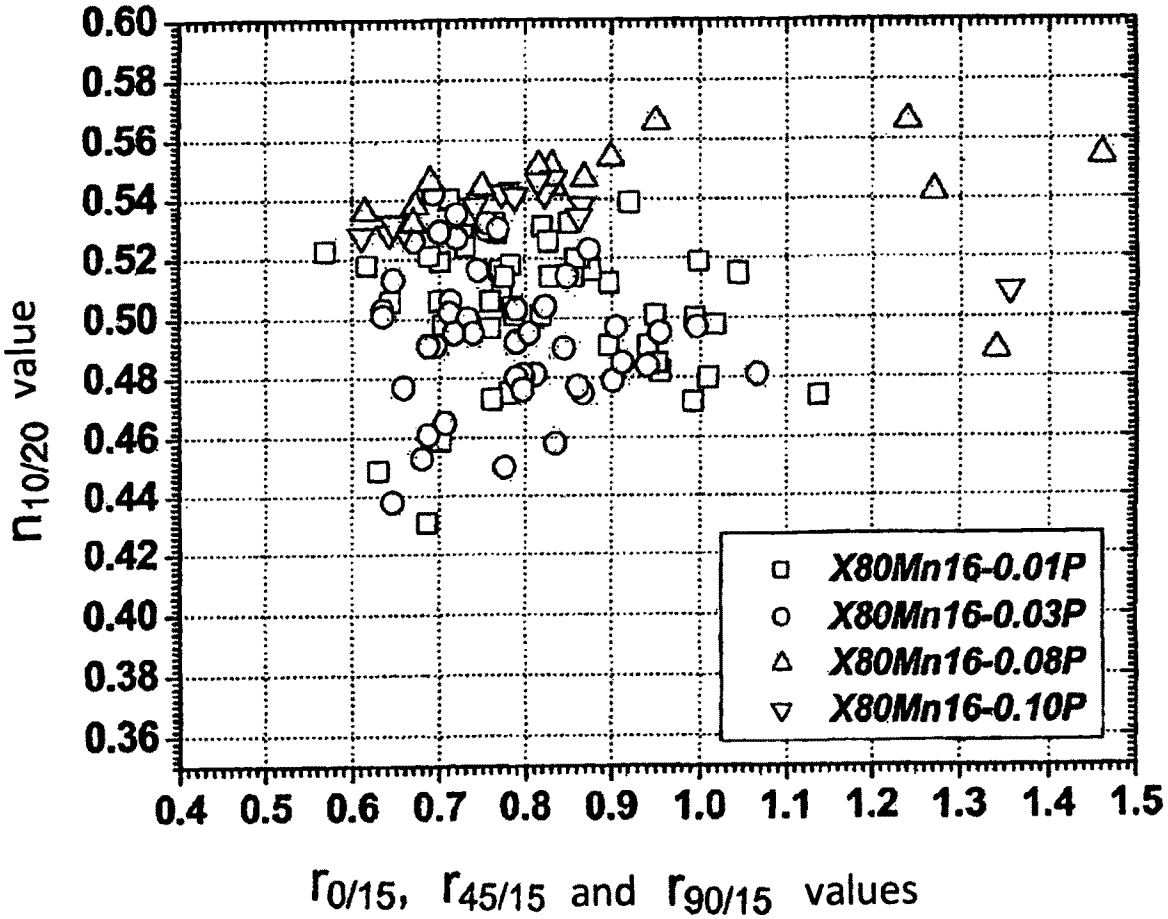
FIG. 2 is a graph showing the strain hardening ($n_{10/20}$ value) for a plurality of samples of cold-rolled steels compared with the vertical anisotropy ($r_{0/15}$, $r_{45/15}$ and $r_{90/15}$ value)

FIG. 2 shows a graph in which the strain hardening n (in this instance the $n_{10/20}$ value) of the above-mentioned steel strips, which is denoted as the strain hardening exponent, is shown compared to the vertical anisotropy ($r_{0/15}$. $r_{45/15}$ and $r_{90/15}$ value). The n-value was ascertained in accordance with standard ISO 10275, 2006-07 edition, which is hereby incorporated into the disclosure of this specification by way of reference. The vertical anisotropy is defined in accordance with standard ISO 10113, 2006-09 edition, which is hereby incorporated into the disclosure of this specification by way of reference. Since the mechanical properties are scattered more widely than the mean grain size shown in FIG. 1, more samples of the aforementioned steel strips were examined. The greater the $r_{0/15}$, $r_{45/15}$ and $r_{90/15}$ values, the better is the capability of the material for deep-drawing. A high n-value favours the capability for stretch-forming in particular. It can be seen from the graph that $n_{10/20}$ values above 0.5 can be achieved with a $r_{0/15}$, $r_{45/15}$ and $r_{90/15}$ value in the range of 0.6 to 1.5. The steel strips, which are rich in phosphorous, of the chemical compositions X80Mn16-0.08P and X80Mn16-0.10P achieve somewhat greater n-values than the steel strips of the chemical compositions X80Mn16-0.01 P and X80Mn16-0.03P. The steel strips according to the invention thus exhibit good cold-formability, which is important in particular for the further processing in stretch-drawing and deep-drawing processes.

Different deformation mechanisms could be observed after the tensile stresses were placed on the steel products according to the invention. The occurrence of different types of twinning was characteristic. It was found that a great many fine microtwins and nanotwins are present in the samples of the steels according to the invention subjected to tensile loading, the mean thickness of which microtwins and nanotwins was, for example, less than 30 nm and, for example lay in the region between 5 and 25 nm, in particular 10 and 20 nm. For example a value of 17 nm was established for the mean thickness of the microtwins and nanotwins in the case of the cold-rolled product X80Mn16-0.03P. The presence of these small microtwins, in particular of the nanotwins, may explain the high elongation at break values, since it leads, by contrast with conventional twinning, to an increasing impairment of the movement of dislocation and to an increase in dislocation sources.

Figure 3A:
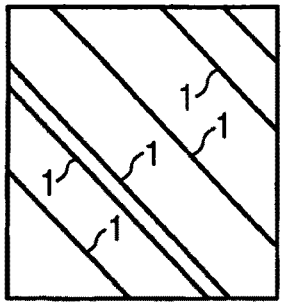
FIGS. 3A-C are schematic views of twins, microtwins and nanotwins in the structure of steels.
Figure 3B:
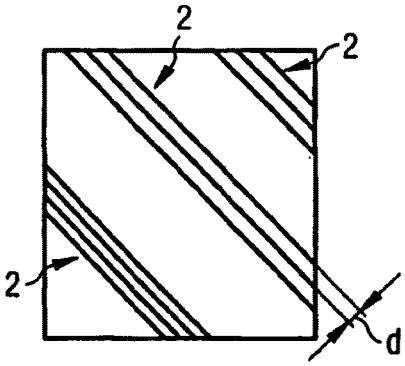
Figure 3C:
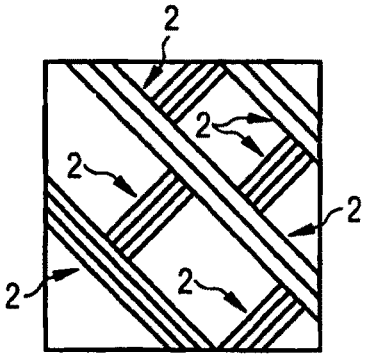

FIGS. 3A-C show schematic views of structures which are observed with electron-beam microscopic tests on reshaped samples of the steels according to the invention. FIG. 3A shows a system which has been activated in one direction and has conventional twinning, wherein the lines 1 represent the mirror lines of the twins.

FIG. 3B shows a system which has been activated in one direction and has microtwins and nanotwins 2. The microtwins and nanotwins 2 are batten-shaped and are often arranged side by side in relatively large numbers. The batten thickness is referred to as the thickness d of the microtwins and nanotwins 2 and is typically substantially smaller than the thickness of conventional twins.

Figure 4:
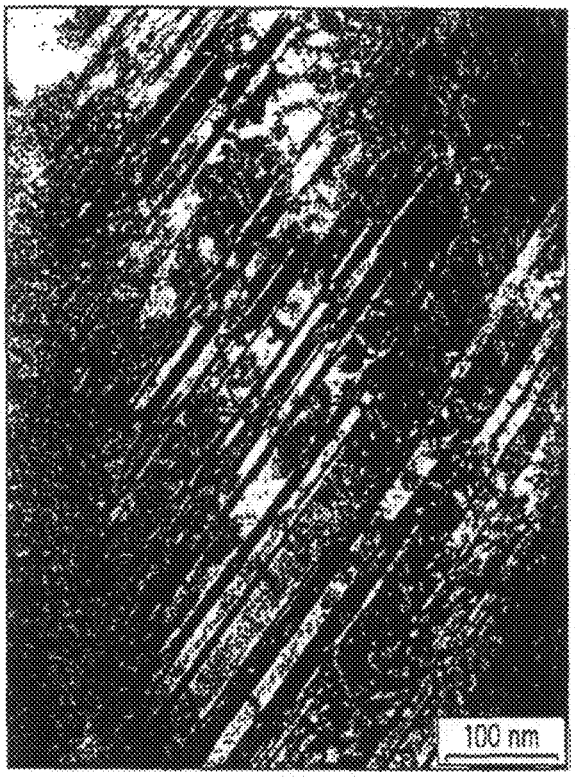
FIG. 4 shows a picture taken with a transmission electron microscope of a steel structure according to an embodiment of the invention.

FIG. 3C shows a system which has been activated in two directions and has microtwins and nanotwins 2. It can be seen that microtwins and nanotwins 2 are formed which extend in both directions, FIG. 4 shows a picture taken with an electron microscope of a steel structure according to the invention after a reshaping process or after tensile loading. A large number of batten-shaped microtwins and nanotwins can be seen in the bright field.

Figure 5:
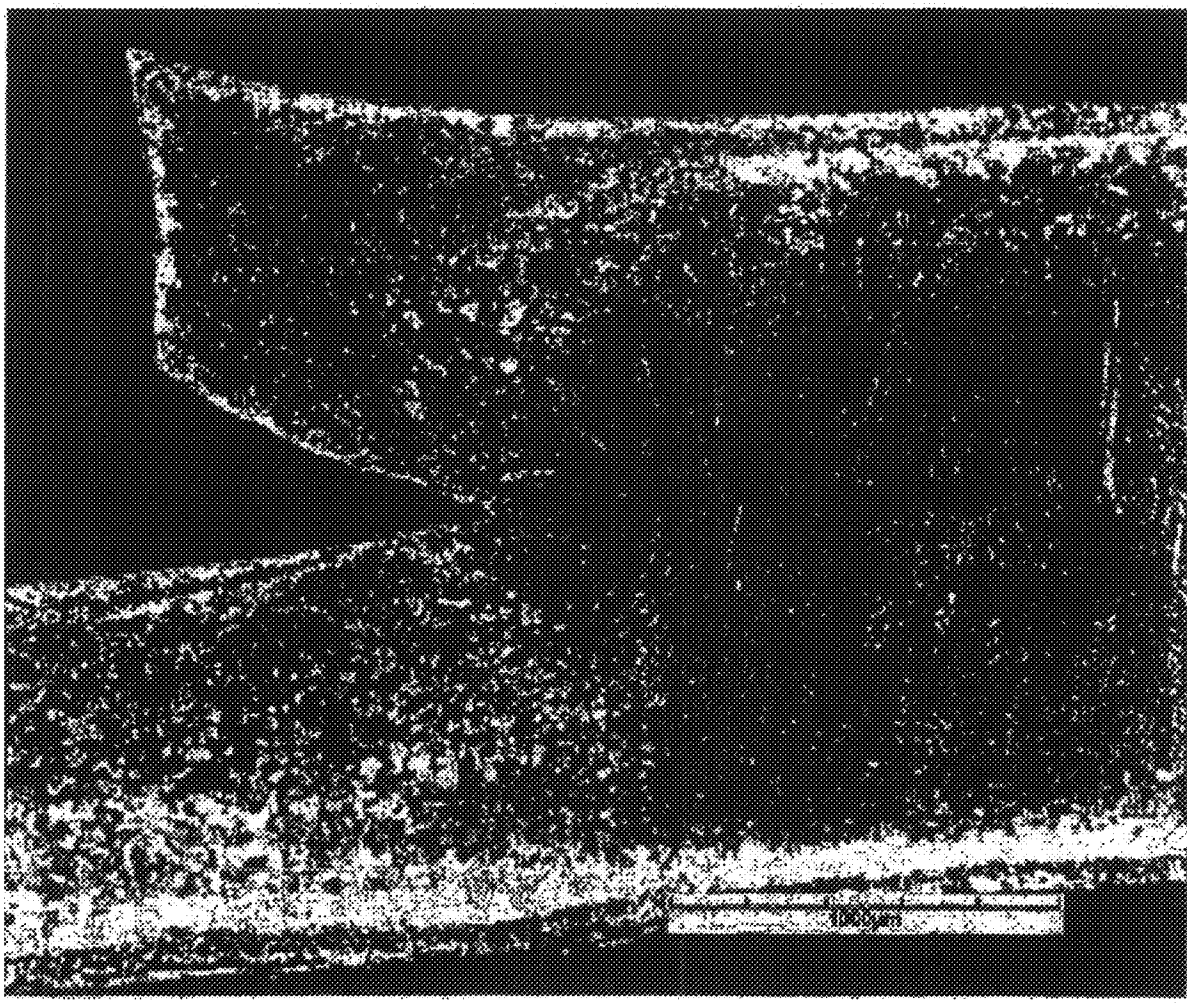
FIG. 5 shows a microsection of the weld nugget of a welded steel structure according to an embodiment the invention.

FIG. 5 shows a microsection of the weld nugget of a steel structure according to the invention after a welding process. X80Mn16-0.10P samples were used. It can be seen that the basic hardness and the maximum hardness in the heat affected zones as well as the hardness in the weld nugget are well matched and only deviate slightly. These deviations lie in the range of the measurement tolerance. It can further be seen that no cracking at all and no martensite are present in the structure.

The TEM structure tests further proved that fractions of ϵ-martensite and possibly also α'-martensite may be present in the structure of the end products. There must therefore be no 100% austenitic phase in the end product, although a 100% austenitic phase should preferably be present. Measurements carried out on the cold-rolled product X80Mn16-0.03P revealed, for example, approximately 3% ϵ-martensite and 1% α'-martensite. Since α'-martensite increases the tensile strength, it is conceivable that the high tensile strength values, which in particular are also still maintained with large grain sizes, are possibly also positively affected by the (albeit relatively low) amount of α'-martensite in the end product.

The n-value is basically given by the chemical composition. That is to say, the strength of the end product which can be achieved by deformation depends on how easily dislocations can proceed in the crystal. In the fcc crystal lattice the solid solubility of C and N is greater than in the bcc crystal lattice. In this instance, as already mentioned, the increase in tensile strength owing to solid solution of C and P is utilised, wherein tensile strength values of 1100 MPa with an extremely high elongation at break of 95% could be measured in tests carried out recently. The hardness achieved by solid solution of the aforementioned elements makes it possible to increase the n-value considerably. As a result the highest previously reported product values for tensile strength and elongation at break are achieved. This is particularly attributed to the use of high phosphorous concentrations and the associated increase in strength, in particular with relatively large mean grain sizes.

During the further processing the hot strip or cold strip is cut into steel sheets which are used, for example, in automotive engineering for the production of body parts. Furthermore, the steel according to the invention can also be used in rails, points, in particular frogs, bar material, pipes, hollow profiled parts or high-strength wires.

The steel sheets are shaped as desired by reshaping processes, for example deep-drawing, and are then processed further into the end products (for example body part). During the reshaping process at least portions of the steel sheets are subjected to a mechanical loading (normally tensile loading), in such a way that the above-mentioned deformation mechanism are effective in these regions. This results in particular in the above-described formation of lots of thin microtwins and nanotwins in the reshaped regions, which microtwins and nanotwins positively affect the reshaping behaviour and can be detected in the (reshaped) steel sheet.

It is again to be understood that all features described in the embodiments and stand-alone embodiments may also be applicable to any other embodiments and stand-alone embodiments as described. Also, it may be pointed out that the above embodiments are exemplary, and that the invention disclosure content herein also covers the combinations of features which are described in different exemplary embodiments, to the extent that this is technically possible.

What is claimed is:

1. A hot-rolled austenitic manganese steel strip having a mean grain size of >18 μm, comprising:

a chemical composition in percent by weight of 0.79%≤C≤1.2%

12.0%≤Mn≤16.5%

0.08%<P≤0.102%

Si≤2%

Al≤0.05%, wherein the steel strip has a product of elongation at break in % and tensile strength in MPa of above 65,000.

2. The hot-rolled austenitic manganese steel strip according to claim 1, wherein a property that the structure of a sample of the manganese steel strip, which has been subjected to a reshaping process, has microtwins with a mean thickness below 30 nm.

3. The hot-rolled austenitic manganese steel strip according to claim 1, wherein 14.0%≤Mn≤16.5.

4. The hot-rolled austenitic manganese steel strip according to claim 1, wherein 0.79%≤C≤0.9%.

5. The hot-rolled austenitic manganese steel strip according to claim 1, wherein Al≤0.02%.

6. The hot-rolled austenitic manganese steel strip according to claim 1, wherein Si≤1.0%.

7. The hot-rolled austenitic manganese steel strip according to claim 1, comprising a tensile strength above 1050 MPa.

8. The hot-rolled austenitic manganese steel strip according to claim 1, with an elongation at break above 65%.

9. A cold-rolled austenitic manganese steel strip having a mean grain size of >15 μm, comprising:

a chemical composition in percent by weight of 0.79%≤C≤1.2%

12.0%≤Mn≤16.5%

0.08%<P≤0.102%

Si≤2%

Al≤0.05%, wherein the steel strip has a product of elongation at break in % and tensile strength in MPa of above 75,000.

10. The cold-rolled austenitic manganese steel strip according to claim 9, wherein a property that the structure of a sample of the manganese steel strip, which has been subjected to a reshaping process, has microtwins with a mean thickness below 30 nm.

11. The cold-rolled austenitic manganese steel strip according to claim 9, wherein 14.0%≤Mn≤16.5%.

12. The cold-rolled austenitic manganese steel strip according to claim 9, wherein 0.79%≤C≤0.9%.

13. The cold-rolled austenitic manganese steel strip according to claim 9, wherein Si≤1.0%.

14. The cold-rolled austenitic manganese steel strip according to claim 9, comprising a tensile strength above 1100 MPa.

15. The cold-rolled austenitic manganese steel strip according to claim 9, comprising an elongation at break above 75%.

16. A manganese steel strip having a mean grain size of >18 μm, comprising:

a chemical composition in percent by weight of 0.79%≤C≤1.2%

12.0%≤Mn≤16.5%

0.08%<P≤0.102%

Si≤2%

Al≤0.05%, and comprising a reshaped portion of which the structure comprises microtwins with a mean thickness below 30 nm.

17. The manganese steel strip according to claim 16, of which the structure comprises microtwins with a mean thickness below 10 nm.

18. The manganese steel strip according to claim 16, comprising a portion which has not been reshaped and produces a product of elongation at break in % and tensile strength in MPa of above 75,000.

19. The hot-rolled austentic manganese steel strip according to claim 1, wherein the percent by weight of C is at least 0.81%.

20. The cold-rolled austentic manganese steel strip according to claim 9, wherein the percent by weight of C is at least 0.81%.

21. The manganese steel strip according to claim 16, wherein the percent by weight of C is at least 0.81%.

22. The cold-rolled austenitic manganese steel strip of claim 9, comprising a mean grain size of at least 18.9 μm.

* * * * *